US012172808B2

(12) United States Patent
Jondal et al.

(10) Patent No.: US 12,172,808 B2
(45) Date of Patent: Dec. 24, 2024

(54) CHILD-RESISTANT MOLDED-FIBER CONTAINER

(71) Applicant: World Centric, Rohnert Park, CA (US)

(72) Inventors: Viktor Jondal, Täby (SE); Jesse Menayan, Sausalito, CA (US); Tyler Harwood, Petaluma, CA (US); Aseem Das, Petaluma, CA (US)

(73) Assignee: World Centric, Rohnert Park, CA (US)

( * ) Notice: Subject to any disclaimer, the term of this patent is extended or adjusted under 35 U.S.C. 154(b) by 0 days.

(21) Appl. No.: 17/546,876

(22) Filed: Dec. 9, 2021

(65) Prior Publication Data

US 2023/0182974 A1 Jun. 15, 2023

(51) Int. Cl.
*B65D 43/16* (2006.01)
*B65D 1/24* (2006.01)
(Continued)

(52) U.S. Cl.
CPC ..... *B65D 50/046* (2013.01); *B65D 1/24* (2013.01); *B65D 25/04* (2013.01); *B65D 43/0222* (2013.01); *B65D 43/162* (2013.01); *B65D 55/14* (2013.01); *B65D 2215/02* (2013.01); *B65D 2501/2421* (2013.01);
(Continued)

(58) Field of Classification Search
CPC .. B65D 5/5076; B65D 2401/00; B65D 25/06; B65D 2543/00305
See application file for complete search history.

(56) References Cited

U.S. PATENT DOCUMENTS 2,041,537 A * 5/1936 Frost ..... B65D 77/202 229/125.13
2,350,950 A * 6/1944 Wiley ..... B65D 43/0222 229/125.17
(Continued)

FOREIGN PATENT DOCUMENTS

DE 202020100019 U1 * 5/2021
GB 2408732 A * 6/2005 ..... B65D 43/021
(Continued)

OTHER PUBLICATIONS

Translation of JP 2004187930 A (Year: 2004).*
(Continued)

*Primary Examiner* — Mollie Impink
(74) *Attorney, Agent, or Firm* — Sterne, Kessler, Goldstein & Fox P.L.L.C.

(57) ABSTRACT

A child-resistant molded-fiber container includes a base, a lid, and a hinge. The base includes an upper surface and a lower surface. The upper surface defines a cavity and the lower surface defines a channel surrounding the cavity. The channel is disposed between an inner sidewall and an outer sidewall of the base. The outer sidewall includes a locking member. The lid includes a sidewall having an opening. The hinge rotatably connects the base and the lid, and allows rotation of the lid between an open configuration and a closed configuration relative to the base. In the closed configuration, the sidewall of the lid is disposed around the outer sidewall of the base and conceals the upper surface of the base. In the closed configuration, the locking member of the base extends through the opening of the lid to inhibit movement of the lid to the open configuration.

18 Claims, 11 Drawing Sheets

(51) Int. Cl.

| | |
|---|---|
| ***B65D 25/04*** | (2006.01) |
| ***B65D 43/02*** | (2006.01) |
| ***B65D 50/04*** | (2006.01) |
| ***B65D 55/14*** | (2006.01) |

(52) U.S. Cl.
CPC ..... *B65D 2543/00194* (2013.01); *B65D 2543/00268* (2013.01); *B65D 2543/00833* (2013.01); *B65D 2555/02* (2013.01)

(56) References Cited

U.S. PATENT DOCUMENTS

| | | | | | |
|---|---|---|---|---|---|
| 2,383,760 | A * | 8/1945 | Barbieri | B65D 43/0222 | 229/5.5 |
| 3,471,078 | A * | 10/1969 | Seest | B65D 85/324 | 206/521.8 |
| 3,902,540 | A * | 9/1975 | Commisso | A47J 47/02 | 220/4.24 |
| 4,746,008 | A * | 5/1988 | Heverly | B65D 55/02 | 220/837 |
| 5,094,355 | A | 3/1992 | Clark et al. | | |
| 5,322,178 | A * | 6/1994 | Foos | B65D 43/162 | 220/756 |
| 5,333,778 | A * | 8/1994 | Specker | B05B 11/026 | 229/120.24 |
| 5,423,477 | A * | 6/1995 | Valdman | B65D 81/3813 | 229/906 |
| 5,518,133 | A * | 5/1996 | Hayes | B65D 43/0212 | 220/793 |
| 5,857,583 | A | 1/1999 | Chantaca et al. | | |
| 7,124,910 | B2 | 10/2006 | Norland | | |
| 8,245,875 | B2 | 8/2012 | Everson | | |
| 9,617,036 | B2 * | 4/2017 | Baker | B65D 43/162 | |
| 2004/0026430 | A1 * | 2/2004 | Baker | B65D 43/162 | 220/4.23 |
| 2005/0205570 | A1 * | 9/2005 | Ramirez | B65D 1/24 | 220/4.21 |
| 2006/0071002 | A1 * | 4/2006 | Hurst | A61B 50/33 | 220/377 |
| 2009/0206090 | A1 * | 8/2009 | Hanson | B65D 43/0212 | 220/526 |
| 2015/0298895 | A1 * | 10/2015 | Corbett | B65B 5/08 | 53/467 |
| 2018/0215523 | A1 | 8/2018 | Chiang et al. | | |
| 2021/0114779 | A1 * | 4/2021 | Bontrager | B65D 43/021 | |

FOREIGN PATENT DOCUMENTS

| | | | | |
|---|---|---|---|---|
| JP | 2004187930 | A * | 7/2004 | |
| WO | WO-2012005683 | A1 * | 1/2012 | B65D 43/022 |
| WO | 2020150280 | A1 | 7/2020 | |

OTHER PUBLICATIONS

For reference DE-20200100019-U1 including translated text (Year: 2020).*

Worth Point Corporation; McDonalds Styrofoam Clamshell Food Container "Big Mac"; 2021; https://thumbs.worthpoint.com/zoom/images1/1/0217/20/mcdonalds-styrofoam-clamshell-food_1_59d679b52c3d08004f712d80811d9eb5.jpg; 6 pages.

International Search Report and Written Opinion directed to related International Patent Application No. PCT/US22/52399, mailed Mar. 16, 2023, 18 pages.

Engineers Edge. "Coefficient of friction and table chart." https://www.engineersedge.com/coefficients_of_friction.htm Engineering, Design and Manufacturing Solutions. Web: site purportedly retrieved Feb. 27, 2023.

* cited by examiner

CHILD-RESISTANT MOLDED-FIBER CONTAINER

FIELD

The present disclosure relates to a container. In particular, embodiments relate to a lockable molded-fiber container.

BACKGROUND

Containers can be used to store and transport items (e.g., during travel). Some containers can be used to store items for personal consumption such as food, beverages, or medicine. Various mechanisms can be used to prevent access to the contents of the container, for example a lock. However, these mechanisms can be complex and may not be child-resistant, and may not be suitable for use with a container formed of compostable material, such as molded-fiber.

BRIEF SUMMARY

In some embodiments, a child-resistant molded-fiber container includes a molded-fiber base, a molded-fiber lid, and a molded-fiber hinge. The molded-fiber base includes an upper surface and a lower surface. The upper surface defines a cavity and the lower surface defines a channel surrounding the cavity. The channel is disposed between an inner sidewall and an outer sidewall of the base. The outer sidewall includes a locking member. The molded-fiber lid includes a sidewall having an opening. The molded-fiber hinge rotatably connects the base and the lid. The hinge allows rotation of the lid between an open configuration and a closed configuration relative to the base. When in the closed configuration, the sidewall of the lid is disposed around the outer sidewall of the base and conceals the upper surface of the base. When in the closed configuration, the locking member of the base extends through the opening of the lid to inhibit movement of the lid to the open configuration.

In some embodiments, the molded-fiber hinge is continuously formed with at least one of the base and the lid.

In some embodiments, the locking member is formed as a bulge in the outer sidewall.

In some embodiments, when in the closed configuration, the bulge extends through the opening such that a bottom edge of the bulge engages the bottom edge of the opening.

In some embodiments, the locking member is flexible such that a bottom edge of the locking member can be pushed through the opening of the lid to unlock the container.

In some embodiments, the base includes a plurality of locking members disposed on opposing sides of the base.

In some embodiments, the base includes a tab having an opening. The lid may also include a tab having an opening. When in the closed configuration, the opening of the base may align with the opening of the lid.

In some embodiments, the base includes a plurality of dividers disposed within the cavity.

In some embodiments, the dividers are integral to the base.

In some embodiments, a child-resistant molded-fiber container includes a molded-fiber base and a molded-fiber lid. The molded-fiber base includes an upper surface and a lower surface, the upper surface defining a cavity and the lower surface defining a channel surrounding the cavity. The channel is disposed between an inner sidewall and an outer sidewall of the base. The molded-fiber lid includes a sidewall extending around a perimeter of the molded-fiber lid.

When in a closed configuration, the sidewall of the lid is disposed around the outer sidewall of the base and conceals the upper surface of the base. When the container is in the closed configuration, an interior surface of the sidewall of the molded-fiber lid engages the upper surface of the molded-fiber base to secure the container in the closed configuration. In some embodiments, the container is maintained in the closed configuration at least in part by friction between a surface of the sidewall of the lid and the upper surface of the outer sidewall of the base.

In some embodiments, the channel has a depth-to-width ratio of 2:1.

In some embodiments, the interaction of the surface of the sidewall of the lid and the upper surface of the outer sidewall of the base have a coefficient of friction of 0.8 to 0.2.

In some embodiments, the cavity has a depth greater than a depth of the sidewalls of the base and the lid.

In some embodiments, the base includes a plurality of dividers disposed within the cavity.

In some embodiments, the dividers are integral to the base.

In some embodiments, the customizable insert includes one or more dividers.

In some embodiments, the base includes a customizable insert disposed within the cavity.

In some embodiments, the child-resistant molded-fiber container includes a molded-fiber hinge rotatably connecting the base and the lid. In some embodiments, the hinge allows rotation of the lid between an open configuration and the closed configuration relative to the base. In some embodiments, the child-resistant molded-fiber container does not include a hinge.

In some embodiments, the child-resistant molded-fiber container includes one or more locking members to secure the container in the closed configuration. In some embodiments, the child-resistant molded-fiber container includes a hinge and one or more locking members to secure the container in the closed configuration.

BRIEF DESCRIPTION OF THE FIGURES

The accompanying drawings, which are incorporated herein and form part of the specification, illustrate embodiments and, together with the description, further serve to explain the principles of the embodiments and to enable a person skilled in the relevant art(s) to make and use the embodiments.

Figure 1:
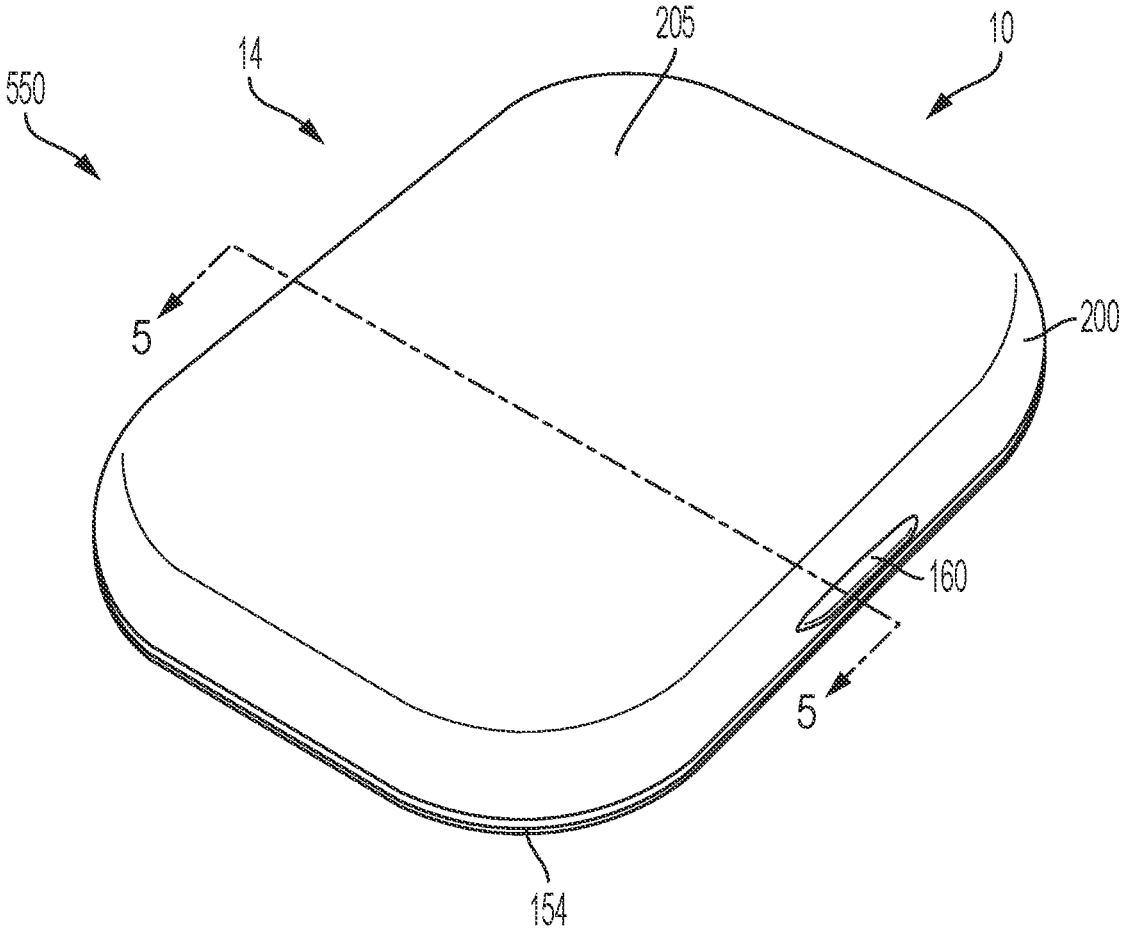
FIG. 1 is a top perspective view of a molded-fiber container in a closed configuration.

The features and advantages of the embodiments will become more apparent from the detail description set forth below when taken in conjunction with the drawings, in which like reference characters identify corresponding elements throughout. In the drawings like reference numbers generally indicate identical, functionally similar, and/or structurally similar elements.

DETAILED DESCRIPTION

Embodiments of the present disclosure are described in detail with reference to embodiments thereof as illustrated in the accompanying drawings. References to "an embodiment," "some embodiments," etc., indicate that the embodiment described can include a particular feature, structure, or characteristic, but every embodiment can not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The term "about" as used herein refers to a considerable degree or extent. When used in conjunction with, for example, an event, circumstance, characteristic, or property, the term "about" can indicate a value of a given quantity that varies within, for example, 1-15% of the value (e.g., ±1%, ±2%, ±5%, +10%, or ±15% of the value), such as accounting for typical tolerance levels or variability of the embodiments described herein.

The following examples are illustrative, but not limiting, of the present embodiments. Other suitable modifications and adaptations of the variety of conditions and parameters normally encountered in the field, and which would be apparent to those skilled in the art, are within the spirit and scope of the disclosure.

Containers can be used to store items for personal consumption such as food, beverages, or medicine. However, containers used to store medicine or other contents may benefit from being child-resistant. Inhibiting access to the contents of a container can be achieved through the use of child-resistant locks. However, child-resistant locks are typically made out of non-compostable materials such as, e.g., rigid plastic. These characteristics can result in a container that is costly, complex, difficult to recycle, and not environmentally friendly (i.e., compostable and biodegradable).

Embodiments of the present disclosure provide a child-resistant molded-fiber container that is compostable, biodegradable, inexpensive to manufacture, and has few components. Embodiments of the present disclosure are configured to safely store and transport various kinds of contents such as, for example, consumables (e.g., food, beverages, and medicine) and personal belongings (e.g., currency, trinkets, jewelry), while also inhibiting children from accessing such contents. The described molded-fiber container with lock inhibits access to the contents of the container in a manner that uses few components, is inexpensive to manufacture, and is compostable and biodegradable.

The container as described herein can include a base and a lid for storing various kinds of contents. In some embodiments, the base and lid are separate components. In some embodiments, the base and lid are hingedly coupled to each other. In some embodiments, the container is sized to hold small items, for example, pills or medicine. In some embodiments, the container is sized to hold larger items or greater quantities of items.

In some embodiments, the base is secured to the lid through friction, snap fitting, and a locking mechanism. In some embodiments, the base is secured to the lid from a combination of friction fitting, press fitting, snap fitting, and locking mechanisms. In some embodiments, the container is configured to inhibit tampering or bypassing the locking mechanism by an unintended person (e.g., a child). In some embodiments, the locking mechanism is configured to inhibit tampering by a child, while also allowing access to an intended person, including individuals who are elderly or who have difficulty with fine-motor skills (e.g. those suffering from arthritis).

In some embodiments, the container is made of biodegradable material, a recycled material, or a material that is both recyclable and biodegradable (e.g., wheat straw, sugarcane, hemp, bamboo, reed grass, miscanthus, recycled paper, hardwood, or softwood). In some embodiments, the container is made of a combination of materials, such as two or more ligno-cellulosic materials (e.g., listed above). In some embodiments, the container is made of one or more ligno-cellulosic materials and a biopolymer (e.g., polylactic acid (PLA), polybutylene succinate (PBS), polybutylene adipate terephthalate (PBAT), Poly(3-hydroxybutyrate-co-3-hydroxyvalerate) (PHBV), Polyhydroxyalkanoates (PHA), Polyhydroxybutyrate (PHB), or Polycaprolactone (PCL)). The container is configured to prevent unwanted access to the contents of the container, specifically from children. As discussed in further detail below, by preventing tampering or unwanted opening of the container, the container can be more secure.

Embodiments will now be described in more detail with reference to the figures. With reference to FIGS. 1-5, for example, a container 10 can include a base 100 and a lid 200 and can be configured to store, transport, or secure contents 5 (e.g., consumables or personal belongings). Contents 5 can include, for example, food, medicine, currency, trinkets, or jewelry.

Figure 2:
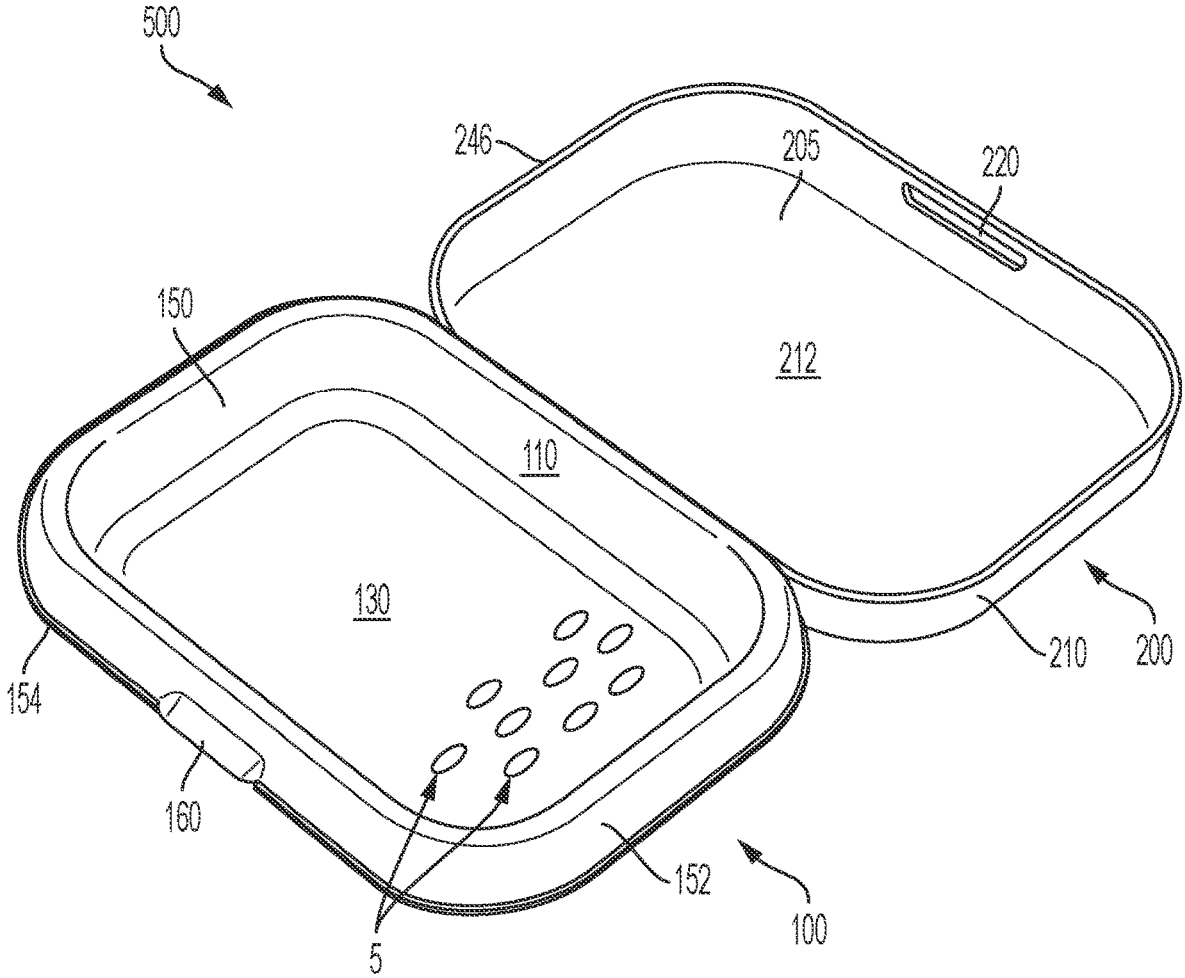
FIG. 2 is a perspective view of the molded-fiber container of FIG. 1 in an open configuration.

With reference to FIG. 2, for example, container 10 can include base 100 and lid 200 coupled to base 100. In some embodiments, when in the closed configuration 550 (e.g., FIG. 1), the lid 200 encloses the base 100. In some embodiments, base 100 encloses lid 200.

Figure 3:
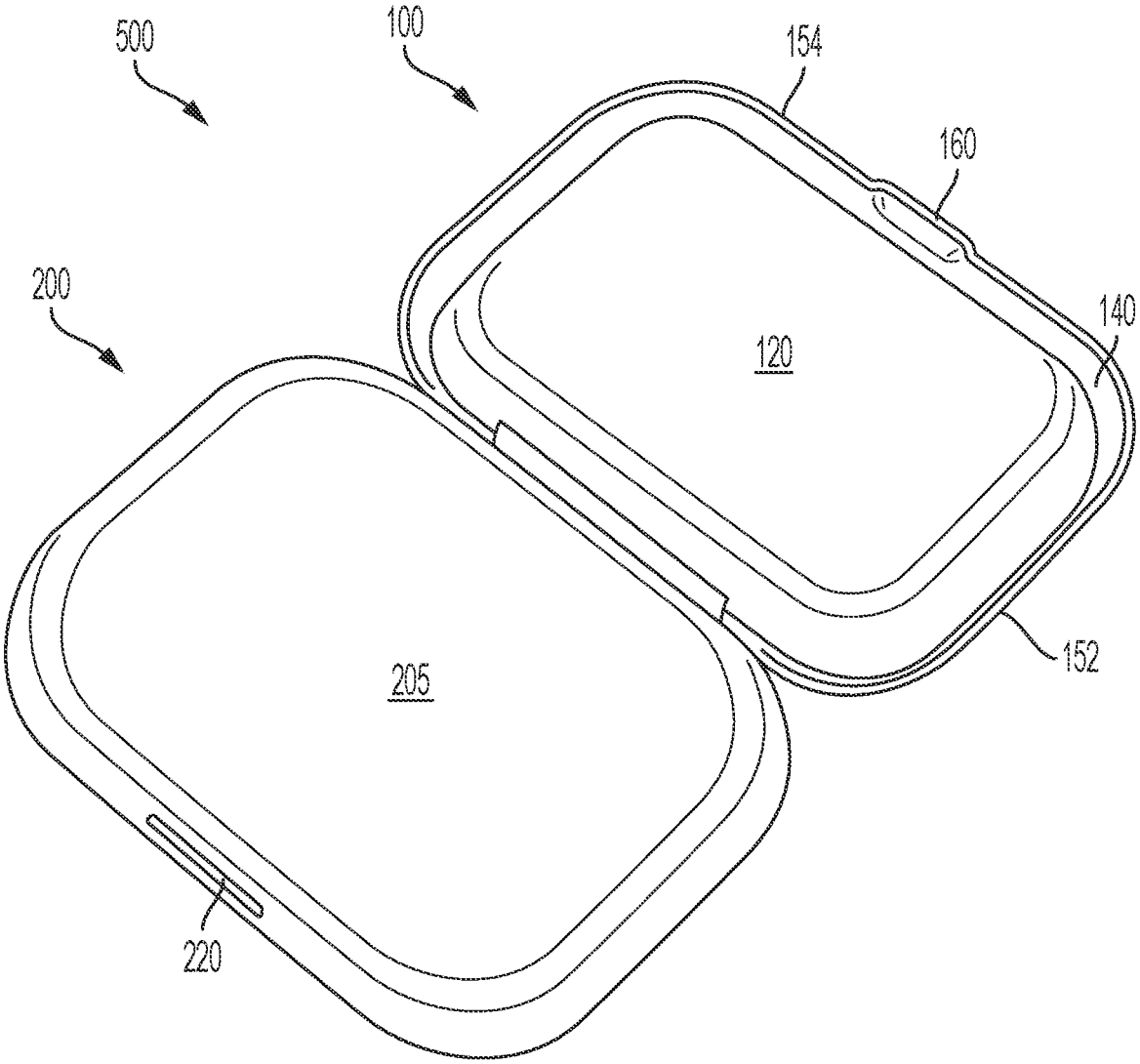
FIG. 3 is a bottom perspective view of the molded-fiber container of FIG. 1 in the open configuration.
Figure 4:
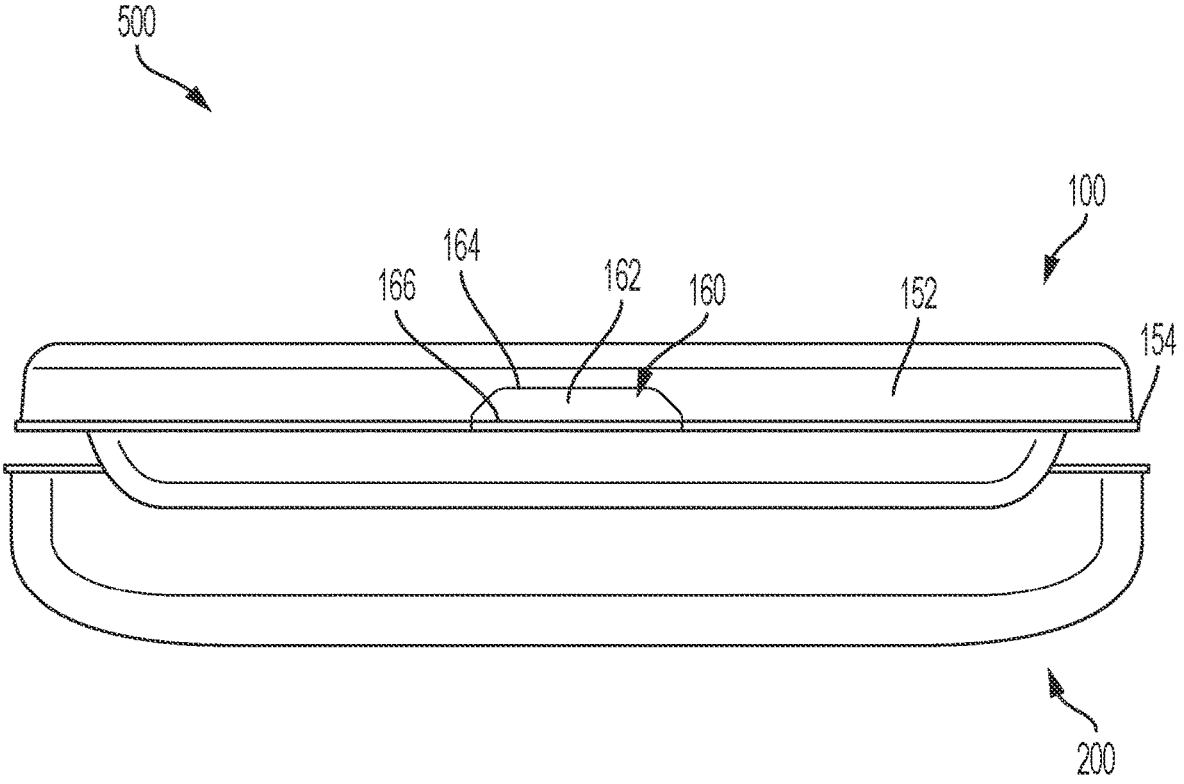
FIG. 4 is a front view of the molded-fiber container of FIG. 1 in the open configuration.

Base 100 includes an upper surface 110 defining a cavity 130, and a lower surface 120 defining a channel 140 (see FIG. 3). In some embodiments, upper surface 110 has a rough surface texture to help inhibit contents 5 from moving around within container 10 during transport or storage and to help secure container 10 in a closed configuration (e.g., when lid 200 is engaged with base 100). In some embodiments, upper surface 110 and lower surface 120 have different surface textures to promote friction. For example, in some embodiments, upper surface 110 and lower surface 120 may have a coefficient of friction between 0.2-1.

Figure 11:
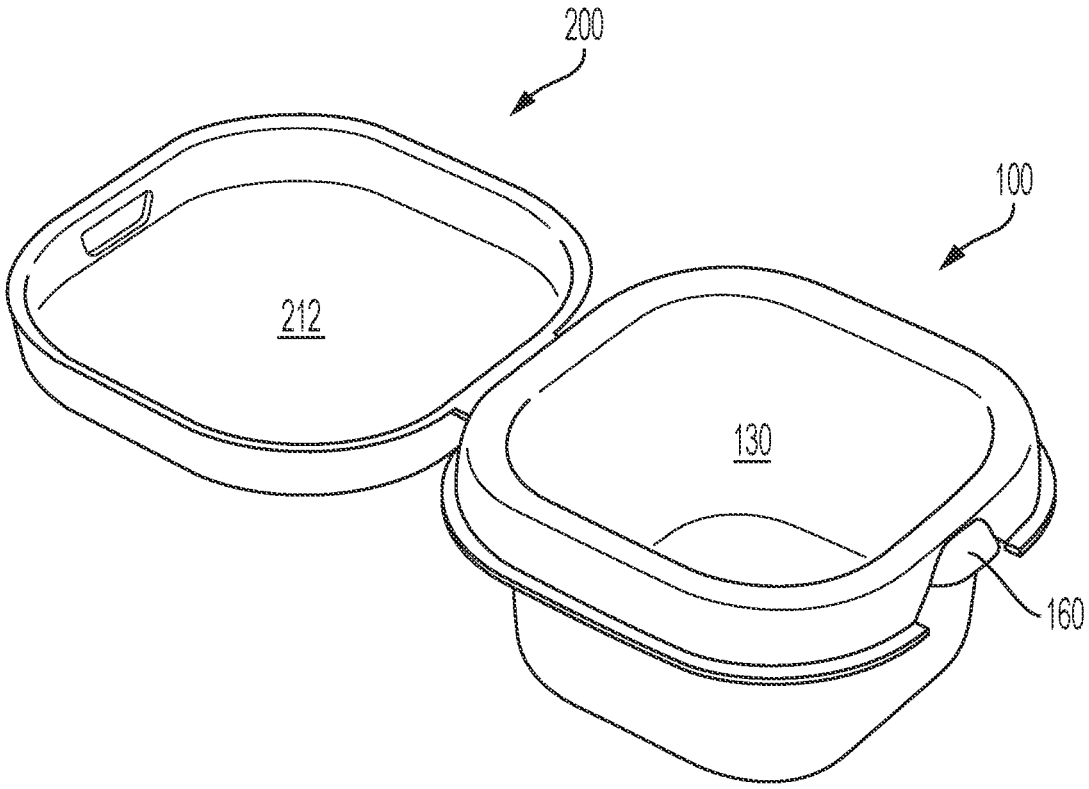
FIG. 11 is a perspective view of a molded-fiber container in an open configuration.

In some embodiments, base 100 includes inner sidewall 150, outer sidewall 152, and bottom edge 154. Cavity 130 is disposed between the inner sidewalls 150 and has a depth of d1 (see FIG. 5). In some embodiments, base 100 can include a plurality of cavities 130. Cavity 130 is configured to house contents 5. For example, in some embodiments, depth of d1 is about 1-2 inches. In some embodiments, depth d1 is less than 20% of width w1. However, in some embodiments, as shown for example in FIG. 11, depth d1 may be equal to or greater than w1 to store larger quantities or different shaped contents 5. In some embodiments, as discussed in more detail below, cavity 130 can house an insert 400 for storing or securing the contents of container 10.

In some embodiments, container 10 can be secured in a closed position through securement mechanisms including friction fitting, material elasticity, and a lock. In some embodiments, container 10 may utilize one or more securement mechanisms.

In some embodiments, base 100 and lid 200 are configured to engage each other when container 10 is in closed configuration 550, and to maintain container 10 in the closed configuration 550. Container 10 may be secured through a friction fit between the upper surface 110 of the base and the interior surface 212 of sidewall 210. When lid 200 is placed over base 100, upper surface 110 contacts interior surface 212. This interaction between contacting surfaces can create a friction fit that secures lid 200 to base 100.

In some embodiments, base 100 and lid 200 are about equal size (e.g., width and depth) such that when lid 200 is placed over base 100, lid 200 is flexed to fit around base 100. The elasticity of lid 200 creates an adhesion force as the lid 200 is trying to compress base 100 such that lid 200 can return to its original shape.

In some embodiments, the surface texture of the upper surface 110 of the base and the surface texture of the interior surface 212 of sidewall 210 have an increased roughness value (i.e., have a high coefficient of friction between the two contacting surfaces) to increase the amount of friction and increase the security of containment. The greater the coefficient of friction, the greater the friction fit, thus the harder the container is to open.

Allowing the container to be maintained in the closed configuration 550 through friction minimizes the necessary components, leverages material properties of molded fiber, and promotes the compostability and biodegradability of container 10.

In some embodiments, container 10 may be further secured in the closed configuration 550 through the use of a locking member 160. Base 100 may include locking member 160. Locking member 160 may be a flexible bulge 162 in outer sidewall 152 of base 100. In some embodiments, as shown for example in FIGS. 2, 4, and 5, bulge 162 extends further away from the outer sidewall 152 at a bottom end 166 than at a top end 164. This configuration allows bulge 162 to have an angled shape that tapers towards outer sidewall 152 as the bulge extends from the bottom end 166 to the top end 164 (see FIG. 4). The tapering shape facilitates easy engagement with an opening 220 in the lid 200. In the closed configuration, bottom edge 154 of base 100 sits above bottom edge 240 of lid 200 (see FIG. 5). This configuration inhibits container 10 from opening unless locking member 160 is disengaged.

In some embodiments, locking member 160 is integral to base 100. For example, bulge 162 may be integral to base 100 (e.g., formed of the same molded-fiber substrate as base 100). Bulge 162 provides a simple and more unitary design for locking member 160 because it does not involve any other components. This allows container 10 to be cheaper to manufacture and promotes the compostability of container 10 since locking member 160 can be made of the same material as container 100.

Figure 10:
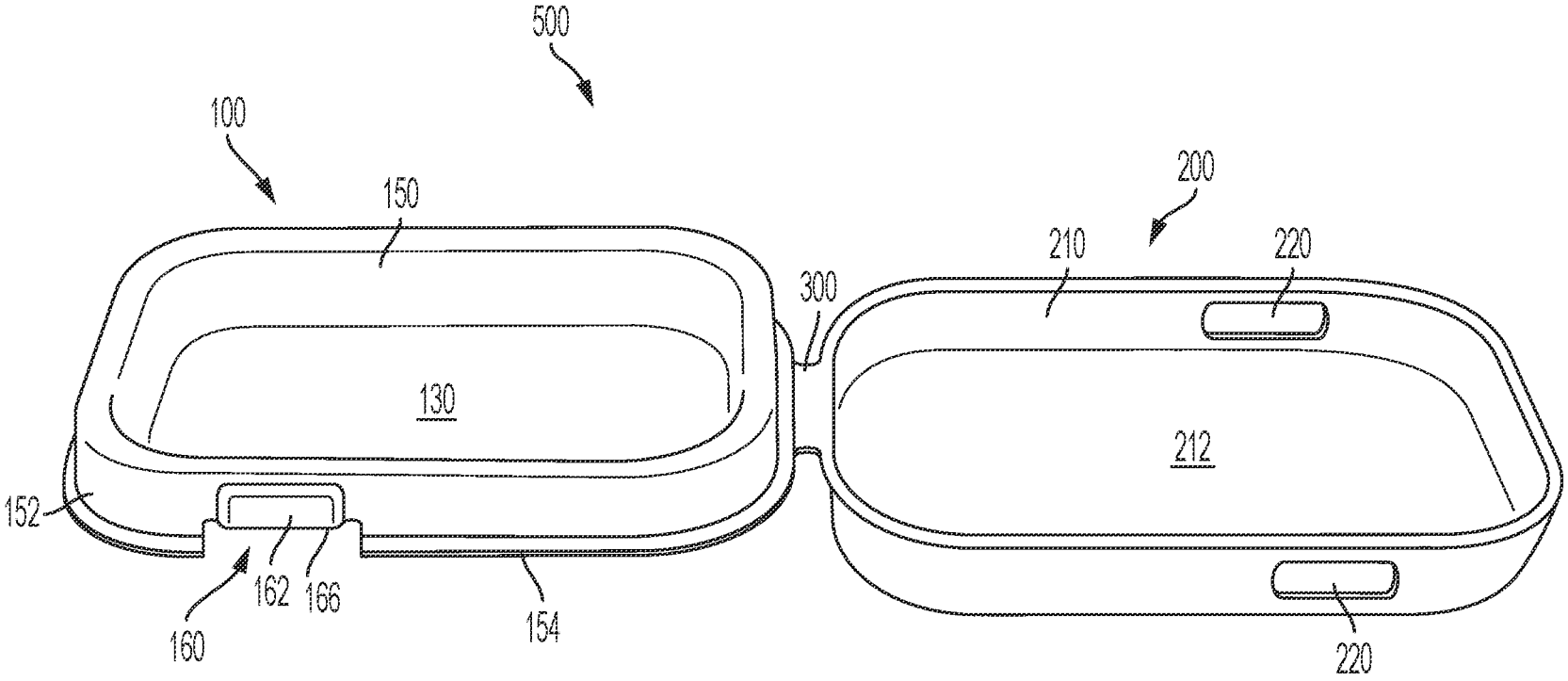
FIG. 10 is perspective view of a molded-fiber container in an open configuration.

In some embodiments, base 100 may include more than one locking member 160, as shown, e.g., in FIG. 10. As shown, locking members 160 may be formed on opposing sides of base 100. In this configuration, a user must depress both locking members 160 to open container 10. This provides additional security to container 10. Additionally, this configuration may be more difficult for a child to open as a child is unlikely to possess the coordination, strength, or hand size to depress both locking members 160 at the same time to open container 10.

In some embodiments, bottom end 166 of locking member 160 may be aligned with bottom edge 154 of base 100. As shown, e.g., in FIGS. 10-11, locking member 160 may be offset from bottom edge 154. In some embodiments, locking member 160 may be formed on lid 200. In some embodiments, locking member 160 is a tab, button, fastener, or any other similar locking mechanism.

Figure 5:
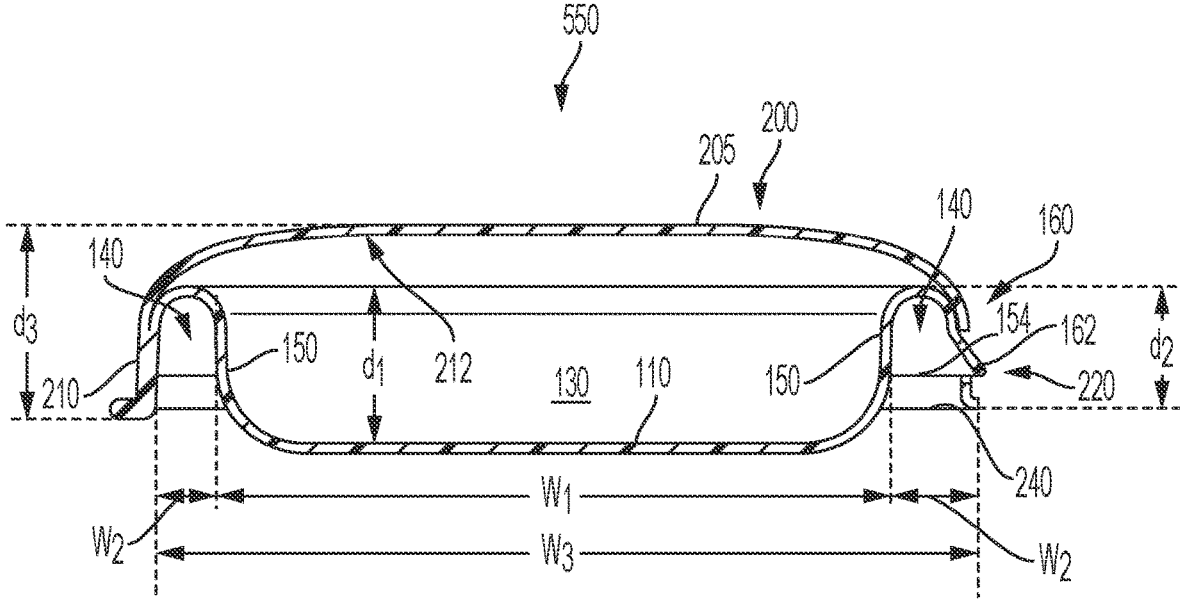
FIG. 5 is a cross-sectional view of the molded-fiber container of FIG. 1, across line 5-5.

In some embodiments, lid 200 includes top wall 205, sidewall 210, opening 220, and interior surface 212 (see, e.g., FIGS. 2 and 5). Lid 200 is configured to engage base 100 to close container 10 and enclose contents 5 within container 10. In some embodiments, sidewall 210 extends fully around top wall 205, defining interior surface 212. In some embodiments, sidewall 210 has an opening 220 that is configured to engage locking member 160 of the base 100. In some embodiments, sidewall 210 includes more than one opening 220 (e.g., the same number of openings as there are locking members 160 in base 100).

Once in the closed configuration 550, container 10 may be released to the open configuration 500 through exerting physical force to overcome the frictional forces of the contacting surfaces. In some embodiments, where locking member 160 is utilized, a user may depress locking member 160. Depressing locking member 160 pushes bulge 162 through opening 220 to disengage locking member 160 from opening 220. Once bulge 162 passes through opening 220, a user can lift bottom edge 240 of lid 200 to open container 10. Without depressing bulge 162, bottom edge 154 of base 100 prevents lid 200 from lifting to the open configuration 500.

In addition to securing container 10 in the closed configuration 550, container 10 may include further child-resistant features to prevent unwanted access to contents 5. In some embodiments, lid 200 has a depth d3. As shown in FIG. 5, depth d3 is greater than depth d2 of channel 140. This configuration allows sidewall 210 of lid 200 to extend past the bottom edge 154 of base 100, thus enclosing outer sidewall 152 of the base. With outer sidewall 152 enclosed, a user will be inhibited from accessing outer sidewall 152 of base 100 and therefore inhibited from prying open container 10. In some embodiments, for further security, depth d3 is greater than depth d1. This configuration allows sidewall 210 of lid 200 to extend past the bottom edge 154 of base, and past the lower surface 120 of base 100, thus further inhibiting access to container 10. As described above, the depth of the lid 200 and channel 140 can be modified to alter the security of container 10.

In some embodiments, as shown for example, in FIGS. 3 and 5, a channel 140 is disposed between inner sidewall 150 and outer sidewall 152. Channel 140 has a depth of d2 and a width of w2. In some embodiments, channel 140 is configured to help inhibit access to container 10 when container 10 is in a closed configuration. For example, the more narrow that channel 140 is (i.e., the smaller the width, w2), the more secure the container 10 is from opening because channel 140 will be too narrow for an unwanted user to pry lid 200 apart from base 100. In some embodiments, the deeper that channel 140 is (i.e., the greater the depth, d2), the less surface area an unwanted user can access for grip to pry lid 200 apart from base 100. In some embodiments, channel 140 has a depth d2 of at least 10 mm and a width w2 of less than 5 mm. The narrow width increases the difficulty of inserting a finger within channel 140 to pry open container 10. Particularly for widths less than the width of a person's finger (e.g., a child's finger). In some embodiments, channel 140 has a depth-to-width ratio of about 2:1. In some embodiments, channel 140 has a depth-to-width ratio of at least 1:1.

Figure 9:
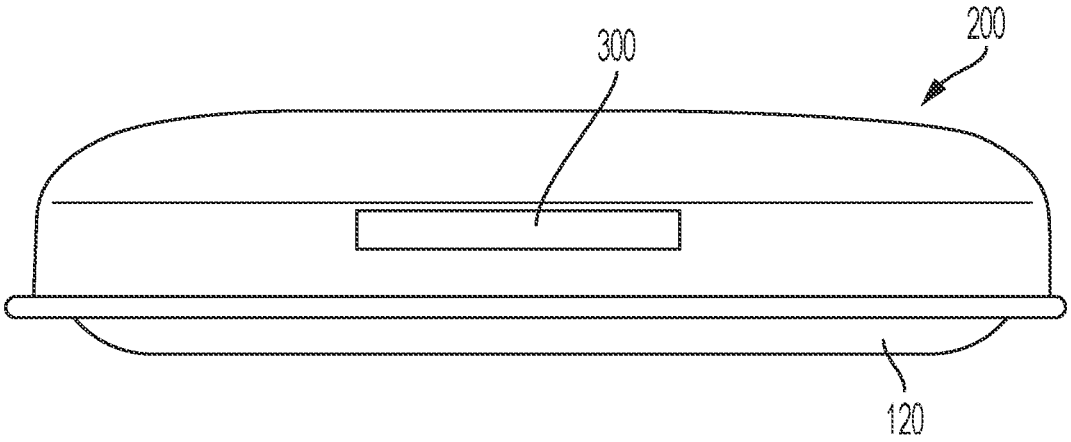
FIG. 9 is a rear view of the molded-fiber container of FIG. 8 in a closed configuration.

In some embodiments, container 10 includes hinge 300 coupled to base 100 and lid 200. As shown, for example, in FIGS. 6-7, hinge 300 allows lid 200 to rotate between a closed configuration 550 (e.g., FIG. 6) and an open configuration 500 (e.g., FIG. 7). In some embodiments, hinge 300 is integral to container 10 and continuously formed with container 10. The width of hinge 300 may vary between embodiments. FIG. 9 shows a rear view of container 10 which illustrates the position and length of hinge 300. The more surface of the outer sidewall 152 that the hinge 300 extends along, the more secure container 10 may be from tampering because of the reduced area for a user to grip to pry open container 10. For example, hinge 300 may extend about 25-75% of the width of one side of outer sidewall 152. In some embodiments, as shown in FIG. 9, hinge 300 may extend about 30% of width w1 (see FIG. 5). In some embodiments, hinge 300 may extend the full width w1 of container 10.

Figure 6:
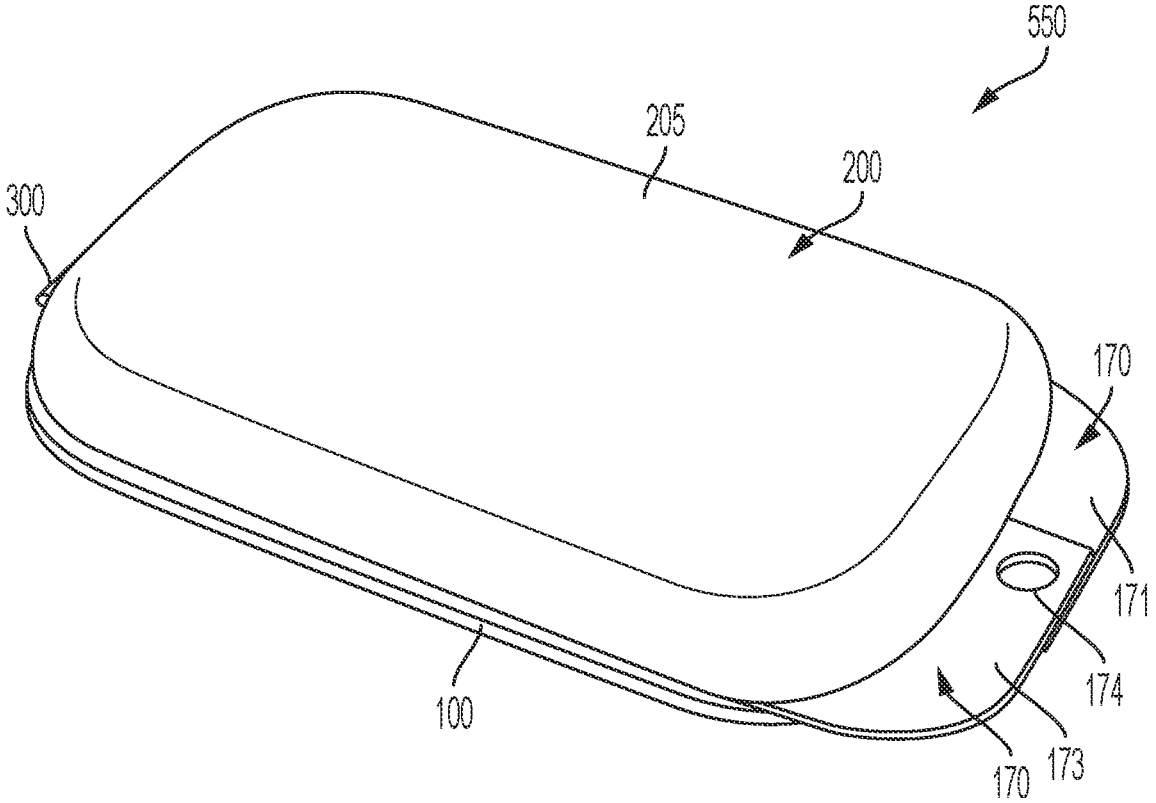
FIG. 6 is a perspective view of a molded-fiber container in a closed configuration.
Figure 7:
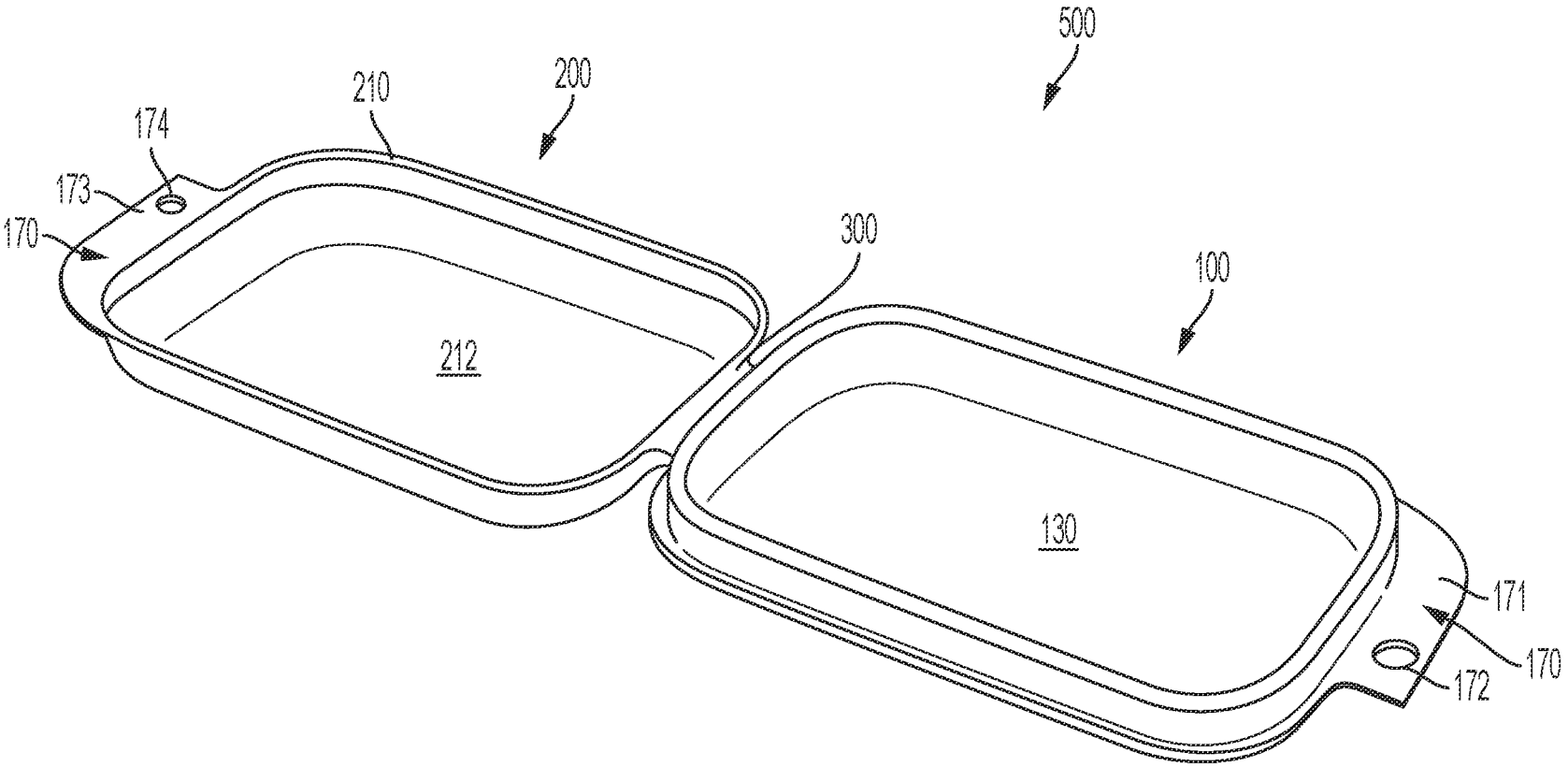
FIG. 7 is a perspective view of the molded-fiber container of FIG. 6 in an open configuration.

In some embodiments, as shown for example, in FIGS. 6-7, base 100 and lid 200 can include hanging tab 170 for facilitating the hanging of container 10 on a product shelf (e.g., for sale or display in a retail store). In some embodiments, hanging tab 170 includes a base portion 171 having an opening 172, and a lid portion 173 having an opening 174. Base portion 171 and lid portion 173, along with openings 172, 174 align when container 10 is in the closed configuration 550. In some embodiments, openings 172 and 174 receive a hanger, product tag, or product seal.

Figure 8:
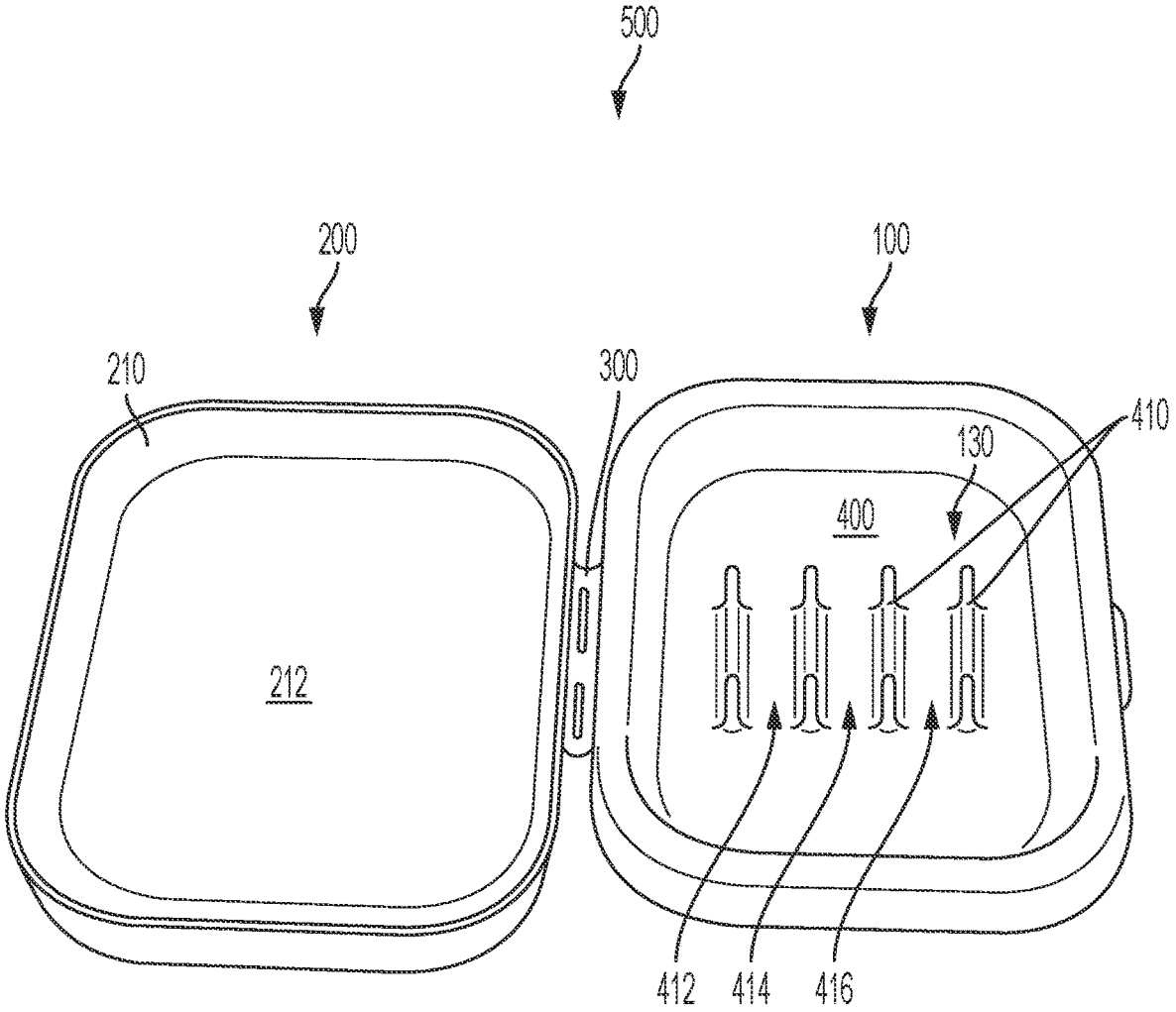
FIG. 8 is a perspective view of a molded-fiber container in an open configuration.

In some embodiments, base 100 includes insert 400 for customizing cavity 130. As shown, for example, in FIG. 8, insert 400 includes one or more dividers 410. In some embodiments, dividers 410 are parallel to one another to allow for easy separation of consumables 5 within container 10. In some embodiments, dividers 410 are arranged to separate cavity 130 into one or more sections 412, 414, 416. In some embodiments, insert 400 is customizable based on the consumables 5 being stored in container 10. In some embodiments, dividers 410 are integral to insert 400. In some embodiments, dividers 410 are formed directly in cavity 130 of base 100.

The shape of container 10 may be customized to store specific contents 5. In some embodiments, as shown for example in FIGS. 1-10, container 10 has a rectangular shape, which is configured to store at least long and slender consumables 5. In some embodiments, as shown for example in FIG. 11, container 10 has a square shape. In some embodiments, container 10 can have a circular, triangular, or polygonal shape. Customizing the shape of container 10 can allow container 10 to store different types and larger quantities of consumables 5, while still providing a child-resistant locking mechanism that prevents unwanted access to the contents of container 10.

In some embodiments, the container 10 can have a hinged configuration (e.g., having base 100 hingedly coupled to lid 200). The hinged configuration allows container 10 to rotate between an open configuration 500 and a closed configuration 550. In some embodiments, the container 10, having the hinged configuration, may include one or more locking members 160 to secure the container 10 in the closed position 550. However, in some embodiments, the container 10 may not include any locking members 160, and instead, the container 10 is secured in the closed position through a friction-fit, snap-fit, or press-fit.

In some embodiments, the container 10 can have a non-hinged configuration (e.g., having base 100 separate from lid 200). In some embodiments, the non-hinged configuration can include one or more locking members 160 to secure the container 10 in the closed position 550. However, in some embodiments, the container 10 may not include any locking members 160, and instead, the container 10 is secured in the closed position through a friction-fit, snap-fit, or press-fit.

It is to be appreciated that the Detailed Description section, and not the Summary and Abstract sections, is intended to be used to interpret the claims. The Summary and Abstract sections can set forth one or more but not all exemplary embodiments of the present embodiments as contemplated by the inventor(s), and thus, are not intended to limit the present embodiments and the claims in any way.

The present disclosure has been described above with the aid of functional building blocks illustrating the implementation of specified functions and relationships thereof. The boundaries of these functional building blocks have been arbitrarily defined herein for the convenience of the description. Alternate boundaries can be defined so long as the specified functions and relationships thereof are appropriately performed.

The foregoing description of the specific embodiments will so fully reveal the general nature of the embodiments that others can, by applying knowledge within the skill of the art, readily modify and/or adapt for various applications such specific embodiments, without undue experimentation, without departing from the general concept of the present disclosure. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

The breadth and scope of the present disclosure should not be limited by any of the above-described exemplary embodiments, but should be defined only in accordance with the following claims and their equivalents.

What is claimed is:

1. A child-resistant molded-fiber container comprising:

a molded-fiber base having an upper surface and a lower surface, the upper surface defining a cavity and the lower surface defining a channel surrounding the cavity, wherein the channel is disposed between an inner sidewall and an outer sidewall of the base, and wherein the outer sidewall includes a bottom edge and a locking member formed as a bulge in the outer sidewall, wherein a bottom end of the bulge extends further away from the outer sidewall than a top end of the bulge, wherein the outer sidewall defines a gap through the bottom edge of the outer sidewall, and the bottom end of the bulge is located above the gap;

a molded-fiber lid having a sidewall, wherein the sidewall defines an opening therethrough; and a molded-fiber hinge rotatably connecting the base and the lid, wherein the hinge allows rotation of the lid between an open configuration and a closed configuration relative to the base, wherein in the closed configuration, the sidewall of the lid is disposed around the outer sidewall of the base and conceals the upper surface of the base, and wherein in the closed configuration, the bulge of the base extends through the opening of the lid to inhibit movement of the lid to the open configuration.

2. The child-resistant molded-fiber container of claim 1, wherein the hinge is continuously formed with at least one of the base and the lid.

3. The child-resistant molded-fiber container of claim 1, wherein in the closed configuration the bulge extends through the opening such that the bottom end of the bulge engages the bottom edge of the opening.

4. The child-resistant molded-fiber container of claim 1, wherein the locking member is flexible such that the bottom end of the locking member can be pushed through the opening of the lid to unlock the container.

5. The child-resistant molded-fiber container of claim 1, wherein the base comprises a plurality of locking members including at least one locking member disposed on opposing sides of the base.

6. The child-resistant molded-fiber container of claim 1, wherein the base comprises a tab having an opening, wherein the lid comprises a tab having an opening, and wherein in the closed configuration the opening of the base aligns with the opening of the lid.

7. The child-resistant molded-fiber container of claim 1, wherein the base comprises a plurality of dividers disposed within the cavity.

8. The child-resistant molded-fiber container of claim 7, wherein the dividers are integral to the base.

9. The child-resistant molded-fiber container of claim 1, wherein the hinge extends from the outer sidewall of the base to the sidewall of the lid.

10. A child-resistant molded-fiber container comprising:

a molded-fiber base having an upper surface and a lower surface, the upper surface defining a cavity and the lower surface defining a channel surrounding the cavity, wherein the channel is disposed between an inner sidewall and an outer sidewall of the base; and a molded-fiber lid having a sidewall extending around a perimeter of the molded-fiber lid, wherein in a closed configuration, the sidewall of the lid is disposed around the outer sidewall of the base and conceals the upper surface of the base, wherein when the container is in the closed configuration, an interior surface of the sidewall of the molded-fiber lid engages the upper surface of the molded-fiber base around the entire outer sidewall of the molded-fiber base to secure the container in the closed configuration, wherein the interior surface of the sidewall of the lid defines a first textured surface and the upper surface of the base defines a second textured surface, and the first and second texture surfaces have a coefficient of friction in a range from 0.8 to 0.2 such that the container is maintained in the closed configuration at least in part by friction between the first textured surface of the lid and the second textured surface of the base, and wherein the channel has a depth-to-width ratio of at least 2:1, and the depth of the channel is at least 10 mm, and the width of the channel is less than 5 mm and greater than 0 mm.

11. The child-resistant molded-fiber container of claim 10, wherein the cavity has a depth greater than a depth of the sidewalls of the base and the lid.

12. The child-resistant molded-fiber container of claim 10, wherein the base comprises a plurality of dividers disposed within the cavity.

13. The child-resistant molded-fiber container of claim 12, wherein the dividers are integral to the base.

14. The child-resistant molded-fiber container of claim 10, wherein the base includes a customizable insert disposed within the cavity.

15. The child-resistant molded-fiber container of claim 14, wherein the customizable insert includes one or more dividers.

16. The child-resistant molded-fiber container of claim 10, further comprising a molded-fiber hinge rotatably connecting the base and the lid, wherein the hinge allows rotation of the lid between an open configuration and the closed configuration relative to the base.

17. The child-resistant molded-fiber container of claim 16, further comprising one or more locking members to secure the container in the closed configuration.

18. The child-resistant molded-fiber container of claim 10, further comprising one or more locking members to secure the container in the closed configuration, and wherein the molded-fiber container does not include a hinge.

* * * * *